United States Patent [19]

Shoenleben

[11] 4,204,739

[45] May 27, 1980

[54] SUBMERSIBLE ELECTRIC MOTOR AND ELECTRICAL CONNECTOR ASSEMBLY

[75] Inventor: Alden W. Shoenleben, Bradford, Ohio

[73] Assignee: Century Electric Motor Co., Gettysburg, Ohio

[21] Appl. No.: 960,162

[22] Filed: Nov. 13, 1978

[51] Int. Cl.[2] ..... H01R 13/54

[52] U.S. Cl. ..... 339/75 R; 339/94 R; 339/103 B; 339/111; 339/147 R; 339/270 R

[58] Field of Search ..... 339/60, 75 R, 75 M, 339/94, 103, 111, 147, 268, 270

[56] References Cited

U.S. PATENT DOCUMENTS

| | | | |
|---|---|---|---|
| 2,056,248 | 10/1936 | Buchanan | 339/268 S |
| 2,642,474 | 6/1953 | Bowar | 339/60 C |
| 3,155,448 | 11/1964 | Korsgren, Jr. | 339/94 A |
| 4,053,196 | 10/1977 | Dunaway | 339/94 R |

*Primary Examiner*—Joseph H. McGlynn
*Attorney, Agent, or Firm*—Jacox & Meckstroth

[57] ABSTRACT

A plurality of separate electrical power supply lead wires each have an exposed end portion projecting from a surrounding insulation. Each lead wire is crimped onto a corresponding collett-like socket member which is inserted into an insulator sleeve disposed within a bore formed within a submersible electric motor housing. Each socket member receives a conductor prong member which projects into the sleeve and is crimped to a stator lead wire. A tubular bushing, a resilient ring and a tubular nut surround the lead wire and project into the upper end of the bore for producing a fluid-tight seal between the insulation on the lead wire and the housing and to press the socket member axially into the sleeve which cams the socket member firmly against the conductor prong member. The conductor prong member projects through a hole within an annular lightning arrestor electrode which defines an electrical gap surrounding the prong member. The prong member is also sealed to the motor housing by a resilient ring which is compressed axially within the lower end portion of the bore by another tubular bushing and a tubular nut which surrounds the stator lead wire.

11 Claims, 3 Drawing Figures

SUBMERSIBLE ELECTRIC MOTOR AND ELECTRICAL CONNECTOR ASSEMBLY

BACKGROUND OF THE INVENTION

This invention relates to improvements in the electrical connector assemblies for submersible electric motors, such as disclosed in U.S. Pat. Nos. 3,997,232 and 4,053,196 which issued to the Assignee of the present invention. In such submersible electrical motors, for example, of the type used in combination with a deep well water pump as disclosed in U.S. Pat. No. 3,250,927, it is common for the motor to be submerged within the well water at a substantial depth. Electrical lead wires, commonly referred to as a "drop cable" extend from an external power source downwardly through the well casing to the electric motor. The motor may be provided with a power supply cord of predetermined length, and the drop cable is connected to the power supply cord by means of a splice or a molded-on cable connector, for example, of the type disclosed in U.S. Pat. No. 2,958,842. It is also common to provide the "drop cable" with a plug-type connector which is molded onto the lower end of the drop cable and plugs into a mating socket member supported within the submersible motor housing. For example, U.S. Pat. Nos. 3,059,210; 3,248,582; 3,294,993; 3,308,316; 3,350,587 and 3,777,194 disclose various forms of electrical plug-type connectors for a submersible electric motor.

As set forth in U.S. Pat. Nos. 3,997,232 and 4,053,196, it has been found highly desirable to eliminate the need for forming a splice with electrical power supply lead wires or a "drop cable" and to simplify the connection of the lead wires to the motor so that it is unnecessary for a motor and/or a motor-pump manufacturer to supply a "drop cable" having a molded-on electrical plug member which mates with the socket member within the motor. Furthermore, the elimination of the plug-type connector eliminates the need for producing and supplying "drop cables" of various lengths corresponding to the depth of the motor-pump unit below the ground surface.

In view of the fact that electric motors submerged within a current conducting liquid such as well water are subjected to electrical grounding, it is desirble to protect the motor from a power or voltage surge, for example, as caused by lightning hitting the electrical power supply lines or "drop cable". One form of lightning arrestor for a submersible electrical motor, is disclosed in U.S. Pat. No. 3,849,704. This arrestor incorporates an electrode within a gas generating, arc extinguishing material contained within a closed casing retained within the motor housing. Another form of lightning arrestor of the type used in connection with the present invention, is disclosed in above U.S. Pat. Nos. 3,997,232 and 4,053,196.

SUMMARY OF THE INVENTION

The present invention is directed to improvements in the connector assembly disclosed in U.S. Pat. Nos. 3,997,232 and 4,053,196. That is, the electrical connector assembly of the invention provides for an improved direct connection of commercially available power supply lead wires to a submersible electric motor without any form of splicing system and in a manner which provides for a direct water-tight seal between the insulation on each lead wire and the motor housing.

In accordance with the present invention, the above features are generally provided within a submersible electric motor by mounting and crimping a collett-type socket member onto each power supply lead wire and then inserting the socket member into an insulator sleeve which is disposed within a bore formed in the submersible motor housing. The socket member receives a fixed prong member which projects upwardly into the sleeve and is connected to the corresponding stator lead wire. A tubular nut, resilient ring and annular bushing are positioned within the bore and have openings for receiving the insulation on lead wire before the socket member is crimped onto the lead wire. The tubular nut compresses the ring and bushing axially within the bore, and the bushing compresses the socket member axially within the sleeve which cams the socket member firmly against the prong member.

The prong member projects axially through an annular lightning arrestor electrode which defines an annular gap. The electrode is retained by an insulator element and another resilient ring which are compressed axially within the lower end portion of the bore by a surrounding insulator pushing and a tubular nut threaded into the lower end portion of the bore.

Other features and advantages of the invention will be apparent from the following description, the accompanying drawing and the appended claims.

DESCRIPTION OF THE PREFERRED EMBODIMENT

Figure 1:
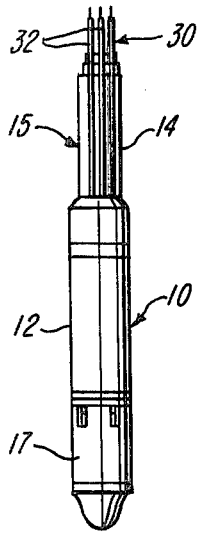
FIG. 1 is an elevational view of a submersible electric motor-pump unit incorporating a plurality of improved electrical connector assemblies constructed in accordance with the invention.
Figure 3:
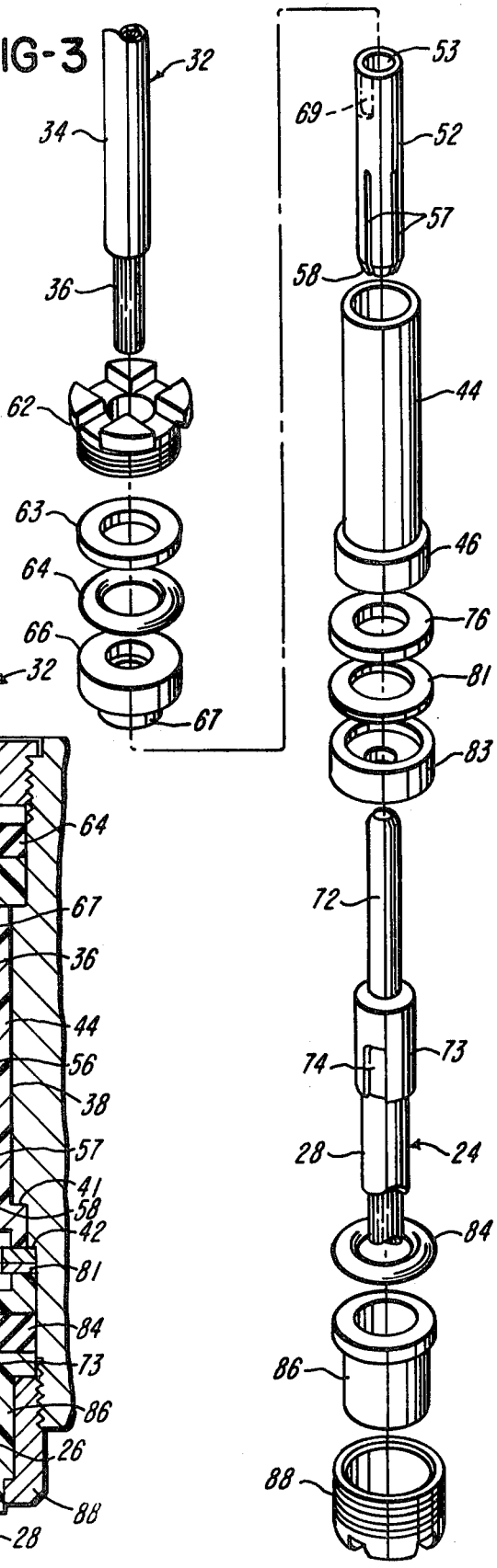
FIG. 3 is an exploded perspective view of the electrical connector assembly shown in FIG. 2.

Referring to the drawing, FIG.1 illustrates a typical deep well submersible motor-pump unit which includes an electric motor 10 having a cylindrical motor housing 12 coupled to a cylindrical housing 14 of a multiple stage centrifugal pump unit 15. The electric motor 10 may be of the oil-filled type, for example, as disclosed in above mentioned U.S. Pat. No. 3,250,927, wherein the lower end of the motor housing 12 is connected with an extension housing 17 for enclosing a starting capacitor as shown in the patent. The electric motor 10 may also be constructed without a starting capacitor and housing 17, and may be of the non-oil filled type, for example, as disclosed in above U.S. Pat. Nos. 3,777,194 and 3,849,704.

In general, the housing 12 of the submersible electric motor 10 encloses a stator (not shown) having a plurality of coil lead wires 24 (FIG. 2) which may extend directly from the coils or connect to the coils through a starting switch andor capacitor such as shown in above U.S. Pat. No. 3,250,927. Each stator lead wire 24 includes an electrical conductor having an exposed end portion 26 projecting from the end of surrounding electrical insulation 28 having a cylindrical outer surface.

Figure 2:
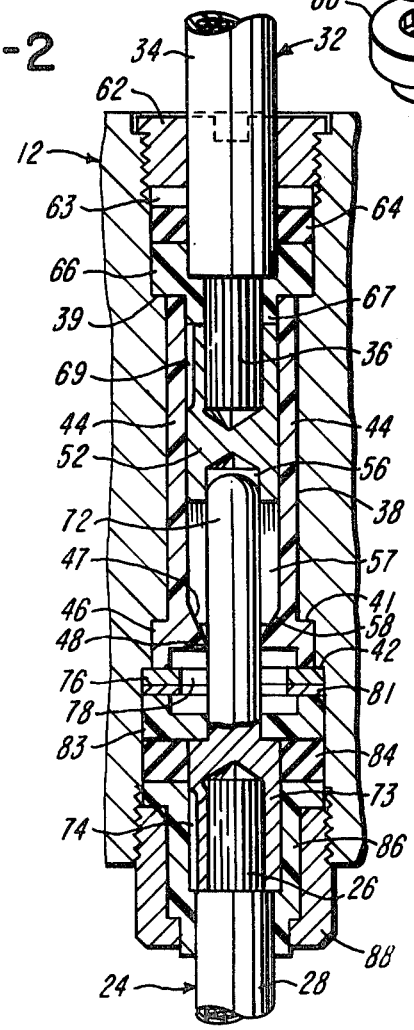
FIG. 2 is an enlarged section of the upper end portion of the electric motor and showing an electrical connector assembly in axial section.

In accordance with the present invention, electrical power is supplied to the motor 10 through a "drop cable" 30 which includes a plurality of three lead wires 32 each including a layer of insulation 34 having a cylindrical outer surface and surrounding a copper electrical conductor having an exposed end portion 36. Referring to FIG. 2, a stepped cylindrical hole or bore 38 is formed within the upper portion of housing 10 for each of the lead wires 32, and each bore 38 is provided with an upwardly facing annular shoulder 39 and downwardly facing annular shoulders 41 and 42.

A rigid sleeve 44 of plastic electrical insulating material, is inserted into the bore 38 through the bottom end and has an enlarged bell-shaped lower end portion 46 with an inwardly projecting lip defining a frusto-conical cam surface 47 extending from a circular hole 48. The sleeve 44 receives a metal conductive collett or socket member 52 which has a top cylindrical opening 53 for receiving the exposed end portion 36 of the power supply lead wire 32. The socket member 52 has a lower end portion defining a cylindrical bore 56 which is interrupted by four circumferentially spaced and axially extending slots 57. The socket member 52 has a tapered or frusto-conical lower end surface 58 which is adapted to mate with the tapered surface 47 within the sleeve 44.

Before the socket member 52 receives the end portion 36 of the lead wire 32, the lead wire receives an externally threaded nut 62, a flat plastic washer 63, a resilient O-ring 64 and a plastic bushing 66, all of which have an inner cylindrical opening for receiving the insulation 34 on the lead wire. The bushing 66 also has a reduced lower end portion 67 which surrounds the wire end portion 36 and is adapted to project downwardly into the upper end portion of the insulator sleeve 44. After the nut 62, washers 63 and 64, bushing 66 and socket member 52 are mounted on the lead wire 32, the socket member 52 is rigidly secured to the wire end portion 36 by a crimp 69 which is performed by crimping pliers.

A conductor metal pin or prong member 72 has an enlarged cylincrical lower end portion 73 which receives the exposed wire end portion 26 of the stator lead wire 24 and is rigidly secured to the end portion by a crimp 74. The prong member 72 projects upwardly through the hole 48 within the sleeve 44 and into the bore 56 within the socket member 52.

An annular lightning arresting electrode 76 is seated against the shoulder 42 within the bore 38 and defines a uniform annular gap 78 surrounding the prong member 72. The electrode 76 is constructed of steel and is retained by a metal arc extinguishing washer 81 having the same inner diameter as the electrode 76. A plastic cup-shaped washer 83 surrounds the prong member 72 and seats on the washer 81. A resilient O-ring 84 engages the plastic insulating washer 83 and closely surrounds the enlarged end portion 73 of the prong member 72.

A tubular plastic bushing 86 surrounds the lower end portion 73 of the prong member 72 and also surrounds the insulation 28 of the stator wire 24. The bushing 86 is retained by a tubular nut 88 which is placed on the stator wire 24 along with the bushing 86 before the prong member is crimped to the end portion 26. The nut 88 is threaded into lower end portion of the bore 38 to compress the resilient ring 84 to form a fluid-tight seal between the prong member 72 and the motor housing 12. The axial compression of the ring 84 by the nut 88 also firmly retains the sleeve 44, the lightning arrester electrode 76, the arc extinguishing washer 81 and the plastic insulating washer 83 within the lower end portion of the bore 38.

After the socket member 52 is inserted into the sleeve 44 and onto the prong member 72, the nut 62 is tightened within the upper end portion of the bore 38. This compresses the resilient ring 64 axially to form a fluid-tight seal between the insulation 34 of the power supply lead wire 32 and the motor housing 12. The axial compression of the bushing 66 in response to tightening of the nut 62, also causes the bushing 66 to press the socket member 52 axially within the sleeve 44. As a result, the cam surface 47 within the sleeve 44 urges the slotted lower end portion of the socket member 52 firmly against the prong member 72 to form a positive electrical connection between the power supply lead wire 36 and the stator lead wire 26.

From the drawing and the above description, it is apparent that a submersible electric motor incorporating an improved electrical connector assembly in accordance with the present invention, provides desirable features and advantages. For example, as one important feature, the improved connector assembly eliminates the need for molding an electrical connecting plug on the lower end portion of a "drop cable" and thus eliminates the need for supplying preformed drop cables in various lengths. In addition, the resilient ring 64 cooperates with the bushing 66 and the nut 62 to form a positive fluid-tight seal between each lead wire 32 and the motor housing 12. Furthermore, the axial force exerted on the bushing 66 and socket member 52 by the ring 64 provides for radially compressing the slotted lower end portion of the socket member 52 so that the prong member 72 is mechanically gripped to assure a positive clamping action and thus a positive electrical connection in addition to a strain resist.

As another important feature, the electrode 76 and arc extinguishing washer 81 provide for a simplified lightning arrestor which effectively grounds a voltage surge within the lead wires 32, and this grounding occurs at a location ahead of the stator coils and of all circuitry within the motor which requires protection. In addition, the particular construction and arrangement of the components provide for conveniently assembling the components within the bore 38 during the assembly of the electric motor. Furthermore, the electrical connector assembly of the invention provides for conveniently and quickly changing or repairing a single standard lead wire, for example, as required when a lead wire is damaged when lowering a submersible motor-pump unit into a well casing.

While the form of electrical connector assembly and method of assembly herein described constitute a preferred embodiment of the invention, it is to be understood that the invention is not limited to this precise form of construction and assembly, and that changes may be made therein without departing from the scope and spirit of the invention as defined in the appended claims.

The invention having thus been described, the following is claimed:

1. An improved electrical connector assembly adapted for coupling a submersible electric motorwire to a power supply lead wire having an exposed end portion projecting from surrounding insulation, said connector assembly comprising means defining a bore, an electrically conducting socket member, a tubular electrical insulator sleeve disposed within said bore and receiving said socket member for axial sliding movement, a resilient ring disposed within said bore and having means defining an opening for receiving said insulation on said power supply lead wire, said socket member having means defining an opening for receiving the exposed end portion of said power supply lead wire, means for securing said socket member to the exposed end portion of said lead wire, a prong member disposed within said bore and projecting into said sleeve and into said socket member, means for electrically connecting said prong member to said motor wire, means for compressing said resilient ring in an axial direction to produce a fluid-tight seal between said insulation of said power supply lead wire and said means defining said bore, and said sleeve including means responsive to axial movement of said socket member within said sleeve for urging said socket member radially inwardly against said prong member to produce a positive electric connection between said socket member and said prong member.

2. An electrical connector assembly as defined in claim 1 wherein said means for compressing said resilient ring comprise a nut member having a generally cylindrical hole for receiving the insulation on said lead wire, and said nut member and said resilient ring are mounted on said lead wire before said socket member is secured to said lead wire.

3. An electrical connector assembly as defined in claim 1 wherein said socket member includes a slotted tubular portion receiving said prong member, and said means for urging said socket member inwardly comprise a tapered cam surface within said sleeve.

4. An electrical connector assembly as defined in claim 1 and including a tubular insulator bushing mounted on said lead wire between said resilient ring and said socket member, and said bushing includes a portion projecting into said sleeve adjacent said socket member.

5. An electrical connector assembly as defined in claim 1 wherein said sleeve includes a portion having a frusto-conical inner surface extending from a hole receiving said prong member, and said socket member engages said inner surface.

6. An electrical connector assembly as defined in claim 1 including an annular lightning arrestor electrode disposed within said bore and surrounding said prong member to define a predetermined annular gap therebetween.

7. An electrical connector assembly as defined in claim 6 including an arc extinguishing washer disposed within said bore and contacting said electrode.

8. An electrical connector assembly as defined in claim 1 wherein said means defining said bore comprise an annular shoulder, and said sleeve includes an enlarged cylindrical portion opposing said shoulder.

9. An electrical connector assembly as defined in claim 8 and including a second resilient ring disposed within said bore and surrounding said prong member, a bushing of insulating material surrounding said prong member, and a tubular nut member for urging said bushing in a direction to compress said resilient ring and urge said prong member against said shoulder.

10. An improved electrical connector assembly adapted for coupling a motor wire within a submersible electric motor to a corresponding power supply lead wire having an exposed end portion projecting from surrounding insulation, said connector assembly comprising means defining a bore within a housing for the motor, an electrically conducting socket member, a tubular electrical insulator sleeve disposed within said bore and receiving said socket member for axial sliding movement, a resilient ring and a nut member adapted to be mounted on the insulation of the lead wire and disposed within said bore, said socket member having means defining an opening for receiving the exposed end portion of the power supply lead wire, means for securing said socket member to the exposed end portion of said lead wire after said nut member and said resilient ring are mounted on the insulation, a prong member disposed within said bore and projecting into said sleeve and into said socket member, means for electrically connecting said prong member to said motor wire within said housing, said nut member being effective to compress said resilient ring in an axial direction to produce a fluid-tight seal between said insulation of said power supply lead wire and said housing, and said sleeve including cam means responsive to axial movement of said socket member within said sleeve for urging a portion of said socket member radially inwardly against said prong member to produce a positive electric connection between said socket member and said prong member and to provide a strain relief for the lead wire.

11. An electrical connector assembly as defined in claim 10 including a bushing adapted to be mounted on the lead wire before said socket member, and said bushing including a portion surrounding the exposed end portion of the lead wire and projecting into said sleeve adjacent said socket member.

* * * * *